United States Patent [19]

Romagnoli

[11] Patent Number: 4,829,742

[45] Date of Patent: May 16, 1989

[54] AUTOMATIC MACHINE FOR THE CONTINUOUS PRODUCTION OF DUAL-USE FILTER SACHETS FOR INFUSION PRODUCTS

[75] Inventor: Andrea Romagnoli, San Lazzaro di Savena, Italy

[73] Assignee: Centind - Centro Studi Industriali - S.R.L., San Pietro Terme, Italy

[21] Appl. No.: 154,782

[22] Filed: Feb. 10, 1988

[30] Foreign Application Priority Data

Mar. 9, 1987 [IT] Italy ..... 3376 A/87

[51] Int. Cl.[4] ..... B65B 9/06; B65B 29/04

[52] U.S. Cl. ..... 53/134; 53/234; 53/117; 53/171; 53/540; 53/550; 156/436; 156/466; 156/510; 156/553; 156/568

[58] Field of Search ..... 156/466, 568, 438, 436, 156/510, 553, 582; 53/550, 229, 230, 234, 134, 117, 540, 531, 171

[56] References Cited

U.S. PATENT DOCUMENTS

| | | | |
|---|---|---|---|
| 2,226,181 | 12/1940 | Ridderstrom | 156/436 |
| 2,919,990 | 1/1960 | Podlesak et al. | 53/550 |
| 3,566,573 | 3/1971 | Irmscher | 53/134 |
| 4,021,993 | 5/1977 | Widmer | 53/234 |
| 4,272,944 | 6/1981 | Suga | 53/550 |
| 4,663,915 | 5/1987 | Van Erden et al. | 53/550 |
| 4,689,100 | 8/1987 | Coleman | 156/568 |

*Primary Examiner*—Michael Wityshyn
*Attorney, Agent, or Firm*—Herbert Dubno

[57] ABSTRACT

An automatic machine for the continuous production of dual-use filter sachets for infusion products, the filter sachets being in the form of bags or pouches containing successive portions of the products. Along the production line there are a succession of devices designed to effect step by step the longitudinal folding and sealing of a strip of filter paper forming therefrom a horizontally extending flattened tube and for the transverse thermal welding of the tube in a manner such as to enclose said individual dosed fractions. A rotary wheel has pickup elements for applying to the flattened tube equidistantly spaced labels, a longitudinally continuous thread transversely contacting the labels, as well as stickers or tabs weldable by alternate transverse thermal welding partly to the back of the labels. The tube is then sectioned into portions comprising at least two bags and the bags are set back to back and sealed together at their extremities.

3 Claims, 3 Drawing Sheets

AUTOMATIC MACHINE FOR THE CONTINUOUS PRODUCTION OF DUAL-USE FILTER SACHETS FOR INFUSION PRODUCTS

FIELD OF THE INVENTION

The present invention relates to an automatic machine for the continuous production of dual-use filter sachets for infusion products.

BACKGROUND OF THE INVENTION

From the Italian patent application No. 3328 A/85 filed on Feb. 8, 1985 by the present applicants, and corresponding to U.S. application Ser. No. 06/823,582 filed Jan. 26, 1986 (now abandoned) which was replaced by copending application Ser. No. 07/107,885 on Oct. 30, 1987, a dual-use filter sachet for infusion products such as tea, camomile and the like is known. This latter application also discloses a method for producing such dual-use filter sachet continuously, effecting in successive steps all the operations required for the formation of the sachets with the appropriate doses of infusion material, the labelling thereof and the provision of a thread for handling of the filter sachet by the user, starting from the traditional filter-paper strip employed for this purpose.

More particularly, according to the latter application, the dual use filter-paper sachet for infusion products is provided as a multiplicity of successive or serially extending bags or pouches, each of which contains a dosed fraction or unit quantity of the infusion products having a structure conforming to two modes of employment, one being in the form of flat-packed lots for sale wherein said bags or pouches are superimposed on each other or are arranged side by side by folding back a bag or pouch over or adjacent to the other, and one in the unfolded or extended array of said pouches following the action of pressure and traction of the corresponding label covering the handling thread of the filter sachet exerted by the user. The thread has a length which is substantially equal to the length of the sachet in its position of use as unfolded bags or pouches, and is attached to the opposite extremity of said sachet by means of a sticker or tab made of a thermally weldable material, jointly with the label made of non-weldable paper, in the proximity of one of said opposite extremities and is arranged to enfold longitudinally the exterior of the said bags or pouches when the latter are arrayed in their mode of use and packed for sale in lots with folded-back pouches in back-to-back arrangement.

As stated above, Ser. No. 07/107,885 also concerns a method for making such a filter sachet with multiple bags or pouches in succession or in series, starting with a continuously formed flattened tube obtained from strip of thermally weldable filter paper and executing on said tubular strip in succession, while it is being flattened in a continuous movement, the operation of feeding in equidistantly spaced portions of the infusion product; the operations of folding, of longitudinal thermal welding and of sequenced transverse thermal welding to enclose the dosed fractions with each transverse thermal weld so that each of said transverse thermal welds constitutes both the bottom and and the closure seal of the successively contiguous bags or pouches; the feeding-in of the labels arranged at a distance from the transverse median line of the alternate transverse thermal welds and the longitudinal introduction of a continuous thread in contact with the external surface of the preformed flattened tube and that of the stickers or tabs made of thermally weldable material for application through this alternating thermal welds partly to the back of the said labels; the thermal welding of said stickers or tabs so as to connect said thread to said labels and said thread to the said tube by means of the said alternating thermal welds; the sectioning of the said tube thus formed along the said transverse median line of the said alternating transverse thermal welds in portions or pieces comprising at least two successive bags or pouches; the folding back of said portions or pieces conprising at least two bags or pouches about the corresponding intermediary transverse thermal weld so as to superimpose or to set up the pouches side by side; and the joining, by means of thermal welding, of the respectively resulting transverse terminal edges there adjoining with the aid of the corresponding stickers or tabs of thermally weldable material.

OBJECTS OF THE INVENTION

The principal object of the present invention is to provide an automatic machine for the continuous production at high production rates of dual-use filter sachets for infusion products of the type described above.

Another object of the present invention is to provide such an automatic machine with high production rates which machine is to be particularly flexible with regard to both the possibility of varying, above all, the quantity of the individual dosed fractions of the infusion products to be filled into each bag or pouch of the individual filter sachets having multiple successive or serial bags or pouches, as well as providing for the construction of the machine itself in a manner that it may operate, as required, with an integrated production line, to manufacture the said dual-use filter sachets having multiple bags or pouches arranged in succession or in series and to make up said individual dual-use filter sachets in container packs and hence, in either case, packing the latter into boxes or cases for their storage and sale or commercial distribution.

SUMMARY OF THE INVENTION

These and yet other objects which will be more apparent from the following are all achieved in the automatic machine according to the present invention for the continuous production of dual-use filter sachets having multiple successive or serial bags or pouches for infusion products such as tea, camomile or the like, which machine comprises means for supporting and folding into a substantially flattened tubular form a strip of thermally weldable filter paper in a continuous, substantially horizontally oriented movement; doser-feeder means for depositing equidistantly spaced fractional doses of the infusion product onto and along the said strip of thermally weldable filter paper whilst the latter is in continuous motion and is being folded into the said substantially flattened tubular shape; blade-shaped folding means capable of folding back the longitudinal edges of said strip of thermally weldable filter paper while the latter is in continuous motion and being formed into the said substantially flattened tubular shape in a vertical arrangement of reciprocal contact to form a longitudinal crest thereon; welding means capable of effecting the thermal welding of said longitudinal edges of said strip of thermally weldable filter-paper in continuous motion in the said vertical arrangement of reciprocal contact forming a crest thereon; means with knurling rollers operating on said longitudinal crest so as to knurl said longitudinal crest of the said strip of filter paper in the said substantially flattened tubular shape and in continuous motion enclosing said equidistantly spaced fractional doses of infusion material; means with rollers and counter-rollers capable of operating laterally relative to said knurled longitudinal crest on said continuously moving strip of filter paper in said substantially flattened shape, drawing in the strip whilst maintaining and enhancing its flattening; angled folding means capable of re-folding laterally the said longitudinally, welded and knurled crest on said strip of filter paper in its tubular flattened form; means with welding rollers and counter rollers for thermally welding in transverse direction said strip of filter paper which is in continuous motion in its flattened tubular shape between the said fractional doses of infusion material so as to enclose said fractions between successive transverse welds, thus effecting that each of said transverse thermal weld constitutes at the same time the bottom and the closure seal, respectively, of the successive contiguous bags or pouches; wheeled or rotating head means provided with means for effecting the pickup and the feed, from a corresponding source located underneath and in contact with the said continuously moving strip of filter paper in said flattened tubular form, a succession of labels each of which is arranged at a distance from the transverse median line of the alternating transverse thermal welds, a continuous longitudinally extending thread in contact with the lower or external surfaces of said succession of labels and a succession of pieces or tabs of thermally weldable material for attachment by said alternating transverse thermal welds partly to the back of said labels; roller means having peripherally equidistant thermal pressure elements capable of operating in counter-rotating combination with said wheeled or rotary head pickup means so as to thermally weld with the aid of the said thermal pressure elements the said thermally weldable stickers or tabs to this thread and the latter to said labels as well as welding the thread to the said continuously moving strip of filter paper in its flattened tubular form by means of said alternating transverse thermal welds; sectioning means for cutting up said continuously moving strip of filter paper thus provided with labels, longitudinal thread, stickers and tabs thermally weldable in accordance with the said median transverse line of said alternating thermal transverse welds into portions or segments comprising at least two bags or pouches in succession; folding and transfer means capable of folding and transferring said sections or segments of the strip of filter paper in flattened tubular form with at least two bags or pouches relative to the median line of the corresponding intervening transverse thermal weld so as to superimpose on each other or to set up said bags or pouches back to back; and thermal welding means capable of joining by thermal welds the respective resultant adjoining transverse edges with the aid of the corresponding pieces or tabs of thermally weldable material.

Another feature of the invention is that the dual-use filter sachets with multiple successive or serially arrayed bags or pouches thus obtained in a continuous manner at high operating speed can be directly collated into lots and packed into cartons or cases for the storage and sale or packed singly in corresponding packets prior to being collated into lots within said cartons or cases.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
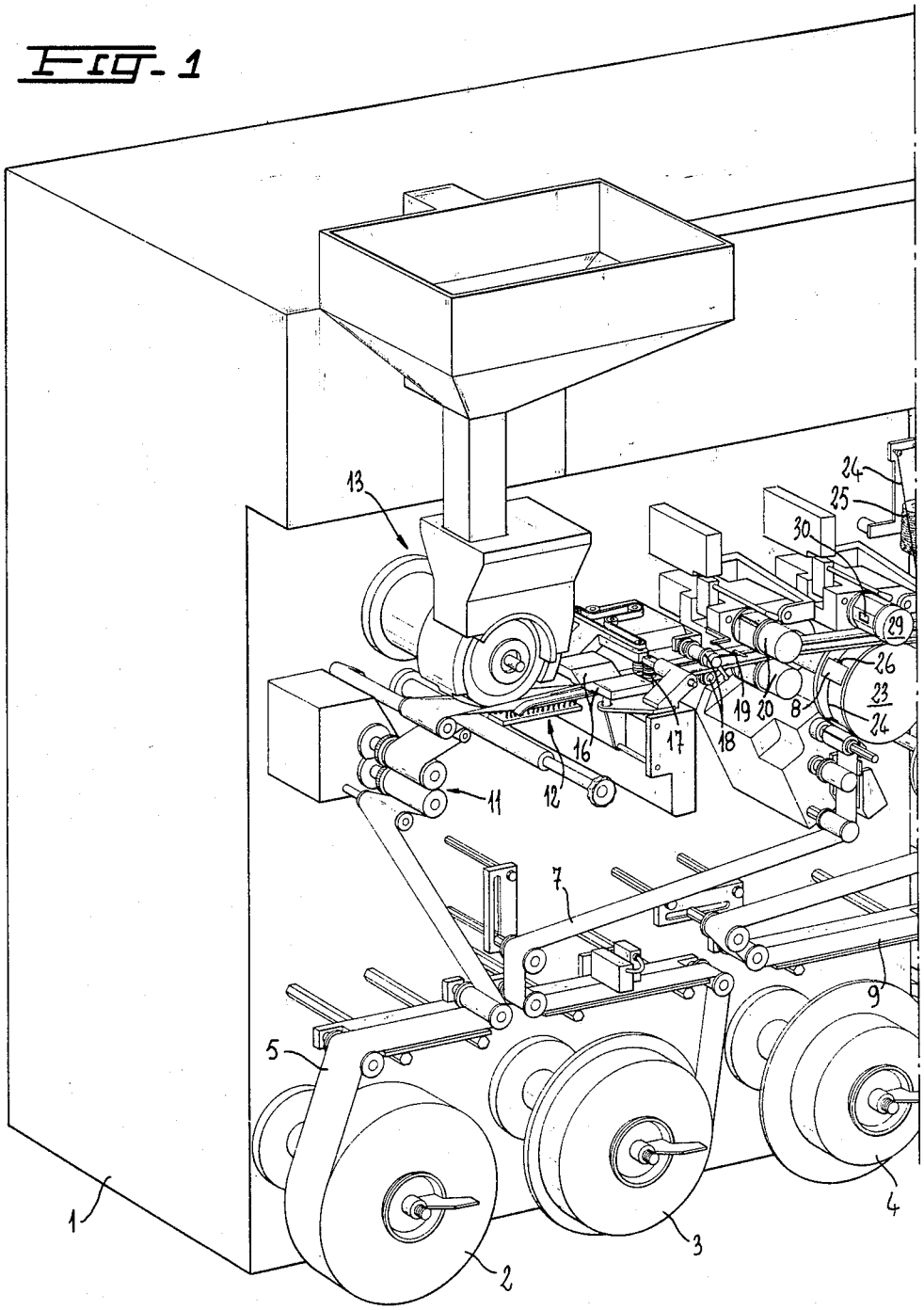
FIGS. 1 and 1A adjoin each other to the right and to the left, respectively, of a common line, and illustrate an automatic machine according to the invention, in a perspective view of a side elevation.
Figure 1A:
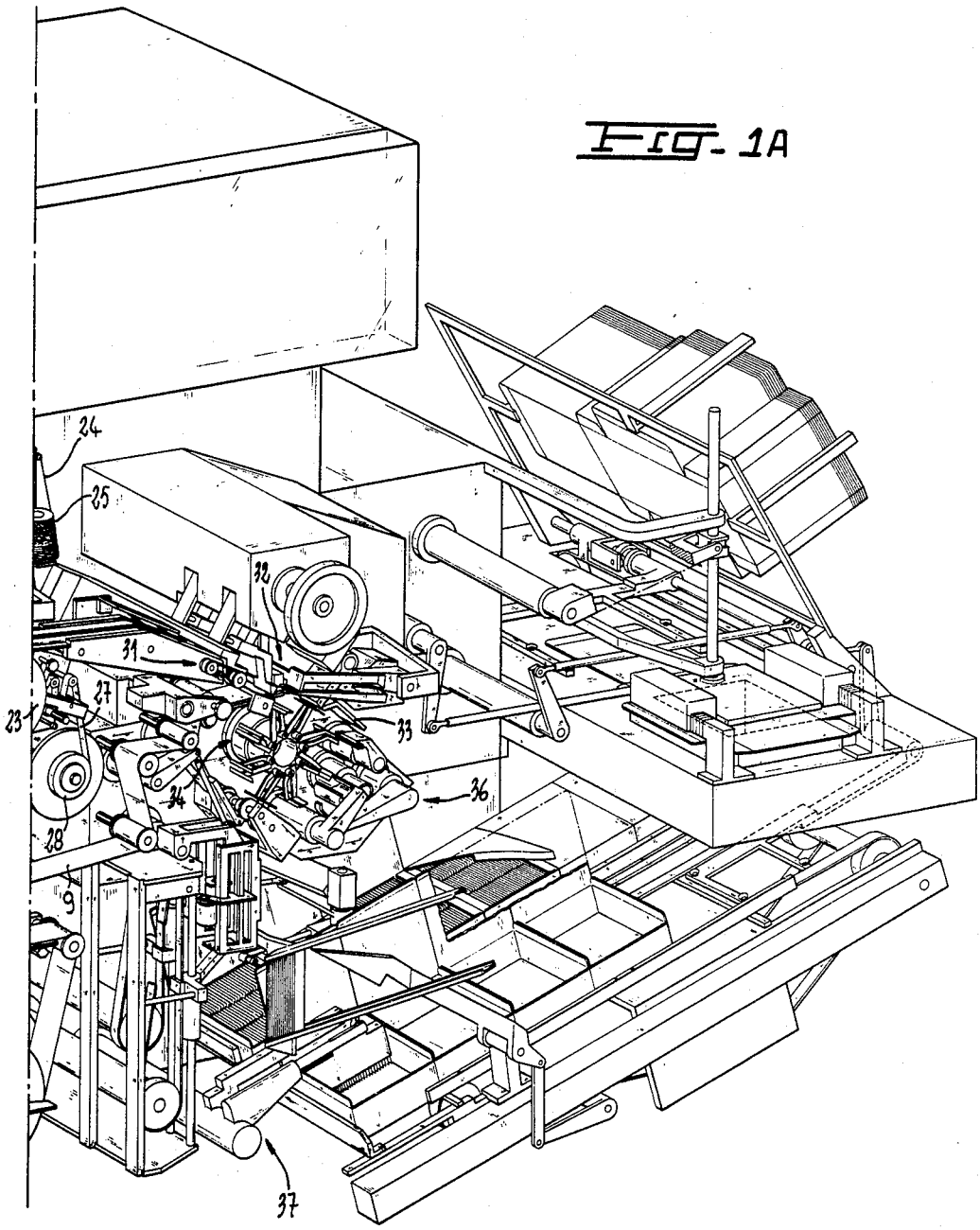

The automatic machine the adjoining parts of which in FIGS. 1 and 1A constitute the integrated operating line, namely that for the continuous production of dual-use filter sachets with multiple successive or serial bags or pouches, each containing a fractional dose of the infusion product, folded back to back and fitted with labels and thread for their handling by the user, said pouches arrayed to follow each other, for the packing of said individual filter sachets in respective outer packs and for collating in lots the said filter sachets thus packed for cartoning or boxing same for storage and sale. Such a production line extends along the front part of the machine frame 1, with the terminal part of the sectioning unit involved in the collating in lots of the filter sachets for packing into cartons or cases extending partly on the downstream flank relative to the machine frame 1.

Figures 2, 2A:
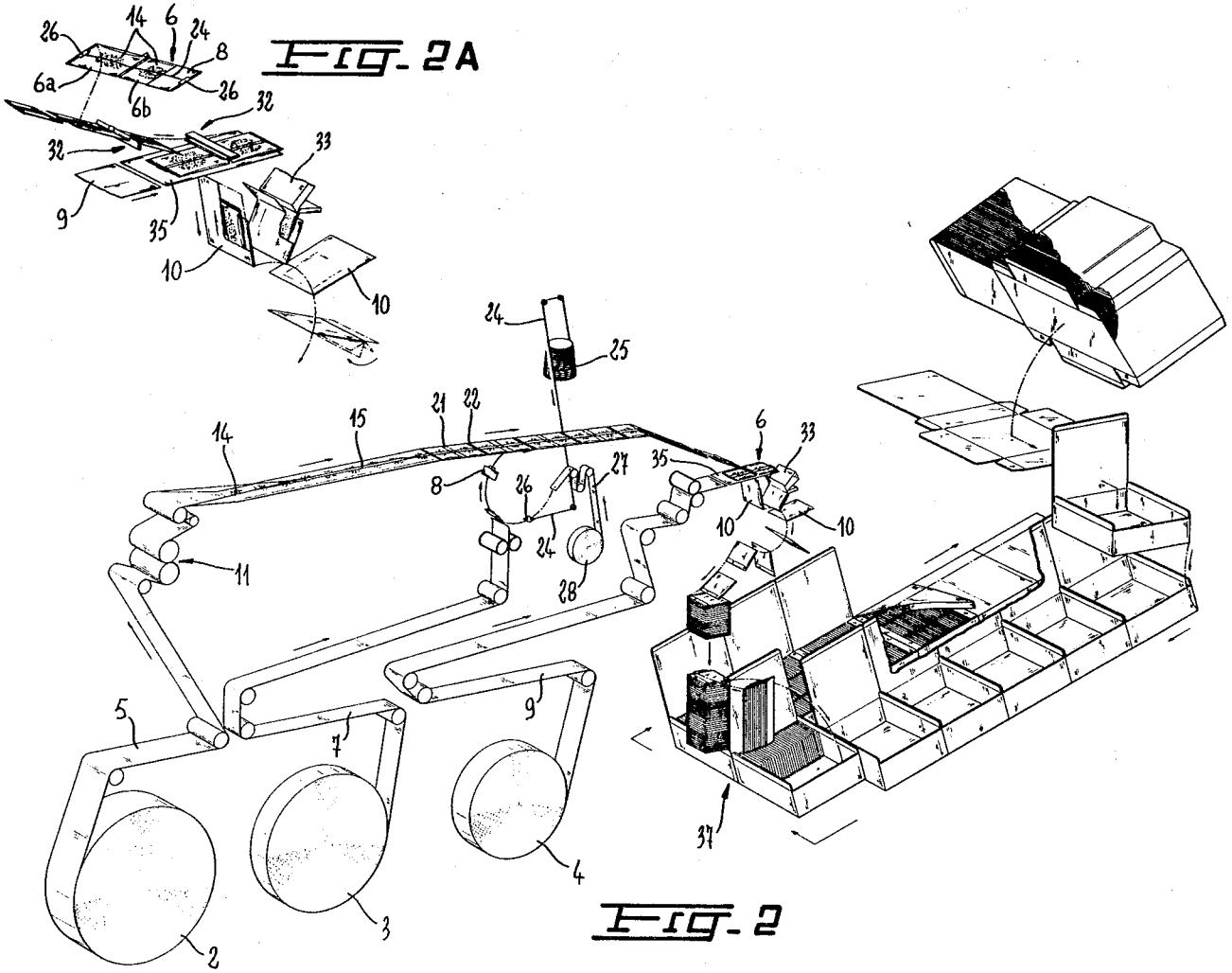
FIG. 2 is a perspective view of front-side elevation but on a smaller scale diagrammatically illustrating the succession of phases along the production line of such an automatic machine according to FIGS. 1 and 1A.
FIG. 2A is a perspective view in greater detail, of some phases of the production line of FIG. 2.

Moreover, in the lower part of said machine frame 1, upstream relative to the production line of the machine, there are provided, in that order, three conventional reels 2, 3 and 4, for feeding in, respectively, the thermally weldable filter-paper strip 5 for the formation of filter sachets 6, the thin carton strip 7 for the formation of the labels 8 and of the paper strip 9 to form the outer packing 10 (see in particular FIGS. 2 and 2A).

The strip of filter paper 5, as usual looped around tensioning rollers is fed, in a substantially horizontal orientation, by means of drawing rollers 11, to brush-equipped support means 12, designed to dissipate the electrostatic charges accumulated in the continuously fed strip and blade-shaped folding means of the type with helicoidal movement for the folding into a substantially flattened tubular form, underneath the feeder-dosing means 13 which can be of the type, for example, described in Italian patent application No. 3377 A/87 corresponding to copending U.S. application Ser. No. 07/154,652 filed concurrently herewith, capable of feeding equidistantly spaced fractional doses 14 (see FIG. 2A) of the infusion product onto and along the said strip of continuously moving filter paper 5 while the latter is being folded in the aforesaid substantially flattened tubular form by means of the support and folding means 12. These latter folding means fold back the longitudinal edges of the strip 5 in vertical arrangement of reciprocal contact in the form of a longitudinal crest 15 (see FIG. 2).

Immediately downstream of these supporting and folding means 12, there are provided multiple-action welding means 16, for example of the type described in Italian patent application No. 3378/ A/87 corresponding to copending U.S. application Ser. No. 07/154,784 filed concurrently herewith, capable of thermally welding together the said longitudinal edges being in reciprocal contact in form of a longitudinal crest 15 on which there operate, immediatement downstream of said multiple-action welding means 16, means with knurling rollers 17 to knurl the said longitudinal crest 15 of said strip of filter paper 5 in the aforesaid substantially flattened tubular form enclosing the aforesaid equidistantly spaced fractional doses 14 of the infusion material. Immediately downstream of said means with knurling rollers 17, there are provided means with transversely spaced rollers and counter-rollers 18 to operate laterally on said knurled longitudinal crest 15 on said continuously moving strip of filter paper 5 in its said substantially flattened tubular form for entraining the strip, maintaining and enhancing the flattening laterally relative to the fractional doses 14 of infusion products. Downstream of said latter means with rollers and counter-rollers 18 there is provided a leaf spring folding means 19 capable of pleating laterally the welded and knurled longitudinal crest 15 on the strip of filter paper in the aforesaid flattened tubular form. Downstream of these last-mentioned leaf-spring folding means 19 I provide means with welding rollers and counter-rollers 20 capable of thermally transversely welding the said continuously moving strip of filter paper in flattened tubular form between the fractional doses 14 of the infusion material along alternating strips 21 and 22 of alternatively differing width, of which the strip 21 is of a greater width than the strip 22, see in particular FIG. 2, so as to enclose said fractional doses 14 with each transverse thermal weld in such a manner that the said transverse thermal weld constitutes at the same time the bottom and the closure seal, respectively of the successive and contiguous bags or pouches **6*a* and 6*b*, see in particular FIG. 2**A.

Following these welding means 20 with rollers and counter-rollers having elements welding transversely along alternating strips 21 and 22 of differing width, there are provided means with wheels or a rotary head 23 provided with pressure elements of differential action, respectively mechanical and pneumatic, for example of the type described in Italian patent application No. 3379 A/87 corresponding to U.S. application Ser. No. 07/154,649 filed concurrently herewith, for the feeding-in from underneath and in contact with the said continuously moving strip of filter paper in its flattened tubular form having successive bags or pouches **6*a* and 6*b* each of which contains a fractional dose 14 of the infusion product, a series of labels 8 cut step by step from the carton strip 7. Each of the labels is located at a slight distance from the median transverse line of the narrower transverse thermal welds 22**.

A continuous thread 24 is drawn from a spool or a reel 25, arranged longitudinally for transversely contacting the lower or outer face of the said series of labels 8 and is likewise applied. A succession of stickers or tabs 26 cut from a strip 27 of a thermally weldable material, known in commerce under the Trademark MYLAR (polyethylene terephthalate film), wound on a reel 28, arranged across the said alternating transverse thermal welds 22, are partially attached to the backs of said labels 8. A roller 29, having peripherally equidistant thermal pressure elements 30 and co-operating in counter-rotation with the aforesaid wheel or rotary head 23 provides, by means of said thermal pressure elements 30, for the thermal welding of said thermally weldable stickers or tabs 26 to said thread 24 and of the latter to said labels 8, as well as the attachment of the thread 24 to the said continuously moving strip of filter paper in said flattened tubular form, accross the aforesaid alternating thermal welds 22.

A thus made-up continuously moving strip of filter paper in flattened tubular form, and thus fitted with labels 8, longitudinal thread 24 and thermally weldable stickers or tabs 26 is then cut, by sectioning means 31, along the median line of the aforesaid alternating thermal welds 22 of smaller width into portions or sections 6 (see FIG. 2A) each comprising two successive bags or pouches **6*a* and 6*b***.

These portions or sections 6 comprise two bags or pouches **6*a* and 6*b*, one following the other, each enclosing a corresponding fractional dose 14 of the infusion material, are then successively folded in the corresponding zone of the wider thermal weld 21 with the aid of folding means in combination with transport elements, for example as described in Italian patent application, No. 3380 A/87 corresponding to copending U.S. application Ser. No. 07/154,650 filed concurrently herewith, generally indicated at 32 in FIGS. 1A and 2A, so as to cause them to register with thermal welding means 33 capable of joining, by thermal welds, the respective adjacent transverse terminal edges with the concurrent aid of the corresponding stickers or tabs 26** of thermally weldable material.

As stated above, a characterising feature of the automatic machine according to the invention as described above is that the dual-use filter sachets with multiple bags or pouches in succession or in series thus obtained continuously at high production rates can be either directly collated into lots and packed in cartons or boxes for storage and sale or can be singly inserted into packets prior to being collated into lots in said cartons or boxes in the manner indicated in FIGS. 1, 1A which is described in the following with reference to FIG. 2A as well.

In the specific case of the integrated line illustrated in FIGS. 1, 1A and 2, underneath and slightly upstream of said folding and transport means referenced 32 in their entirety, there is provided a wheel with radial grips referenced 34, to which are fed paper sections 35 (see FIG. 2A) cut successively from the strip 9 supplied by reel 4. These said paper sections 35, by means of folding and sealing elements 36, are in succession first of all folded in the shape of a V, in the prongs of which are located the individual filter sachets and are then sealed along three sides in the form of a packet enclosing a respective filter sachet, in the manner described in Italian patent application No. 3381 A/87 and the copending concurrently filed U.S. application Ser. No. 07/154,783 corresponding to it. The filter sachets thus packed are then collated in stacks or lots and the latter packed into cartons or boxes by the apparatus 37, as is better apparent of the last-mentioned Patent Application.

The description of the automatic machine in question, made with reference to the Figures of the attached drawings, is obviously given solely by way of example and it is equally obvious that all modifications and variants thereof suggested by practice and its actuation or operation or use fall within the scope of the following claims.

I claim:

1. An automatic machine for continuous production of dual-use filter bags for an infusion product comprising:

a machine frame;

means on said frame for feeding a strip of thermally weldable filter material along a substantially horizontal path;

first folding means on said frame along said path for folding edges of said strip upwardly to meet along a substantially vertical crest;

feeder means on said frame upstream of said folding means along said path for feeding said infusion product in equidistantly spaced fractional doses onto said strip whereby said doses are enclosed in a tube formed from said strip by the inward folding of said edges;

first welding means downstream of said folding means along said path and on said frame for continuously welding said edges together at said crest to form a welded crest;

a pair of knurling rollers mounted on said frame along said path downstream of said welding means for knurling the welded crest to form a knurled welded crest;

flattening means on said frame along said path for flattening said knurled welded crest against said tube and flattening said tube;

second welding means on said frame downstream of said flattening means for transversely forming welds between successive doses across said tube so as to enclose said doses within pouches between successive transverse welds whereby said successive transverse welds alternately form respective bottom welds and closure seals of continuously interconnected successive bags each having a pair of said pouches;

supply means on said frame below said path for feeding to said path a succession of labels, a continuous longitudinal thread transversely contacting surfaces of said labels and a succession of tabs of thermally weldable material;

roller means on said frame along said path and receiving said labels, said thread and said tabs from said supply means and thermally welding said tabs to said thread and said thread to said labels and to said tube across said transverse welds at a location downstream of said second welding means along said path;

means on said frame downstream from said roller means for dividing pairs of said pouches from said tube along said closure seals;

second folding means on said frame downstream of said dividing means for folding successive said pairs of pouches along said transverse bottom welds to position said pouches of each pair side by side; and third welding means on said frame downstream from said second folding means for welding the pouches of each pair together along said transverse closure seals thereof with the aid of respective said tabs.

2. The machine defined in claim 1 wherein:

a charge-dissipating brush is provided in contact with the underside of said strip along said path in the region of said feeder;

said first folding means includes blades having generally helicoidal edges for inwardly folding said edges of said strip as said strip is advanced passed said blades along said path; and said roller means includes a rotary head provided with pickup elements for said labels, thread and tabs.

3. The machine defined in claim 1, further comprising means on said frame for erecting boxes adapted to receive said bags; and stacking means downstream of said third welding means for forming stacks of said bags and transferring said stacks to said boxes.

* * * * *